US006478444B2

(12) United States Patent
Schaerer et al.

(10) Patent No.: US 6,478,444 B2
(45) Date of Patent: Nov. 12, 2002

(54) FURNITURE SYSTEM HAVING A MODULAR LIGHTING INSTALLATION

(75) Inventors: Alexander Schaerer; Stephan Kuenzi, both of Bern; Fritz Fluehmann, Muensingen, all of (CH)

(73) Assignee: USM Holding AG, Guemligen (SE)

( * ) Notice: Subject to any disclaimer, the term of this patent is extended or adjusted under 35 U.S.C. 154(b) by 0 days.

(21) Appl. No.: 09/741,044

(22) Filed: Dec. 21, 2000

(65) Prior Publication Data

US 2001/0014018 A1 Aug. 16, 2001

(30) Foreign Application Priority Data

Dec. 24, 1999 (EP) ..... 99811209

(51) Int. Cl.[7] ..... A47B 23/06

(52) U.S. Cl. ..... 362/133; 362/125; 362/127; 312/223.5; 312/223.6

(58) Field of Search ..... 362/127, 133, 362/125; 312/223.5, 223.6; 52/28, 36.1, 220.7

(56) References Cited

U.S. PATENT DOCUMENTS 4,689,726 A * 8/1987 Kretzschmar ..... 362/127
5,057,978 A 10/1991 Conti ..... 362/125
5,690,415 A * 11/1997 Krehl ..... 362/125
5,695,261 A 12/1997 Slesinger et al. ..... 312/223.6
6,042,244 A * 3/2000 Witkoski ..... 362/133

FOREIGN PATENT DOCUMENTS

WO WO 94/21961 * 9/1994
WO A1-9738610 10/1997

* cited by examiner

*Primary Examiner*—Sandra O'Shea
*Assistant Examiner*—Hargobind S Sawhney
(74) *Attorney, Agent, or Firm*—Birch, Stewart, Kolasch & Birch, LLP

(57) ABSTRACT

A furniture unit has a plurality of mutually delimited furniture compartments, which in particular are designed as display cabinets. At least one lighting member can be installed as required in each furniture compartment. Rod elements of a predetermined length are provided to carry the electrical current and are affixed within the furniture unit. Furthermore, mountings are provided whereby the rod elements can each be completely retained within a furniture compartment. Connection elements provide an electrical connection between rod elements of different furniture compartments. The connection elements are designed as flexible conductors in some regions and may be 1:n branches (n=2, 3, etc.). The mountings are so arranged and designed that the rod elements are essentially fixed at both ends, it being possible for the connection elements to be connected at any time, as necessary to the ends of the rod elements.

12 Claims, 3 Drawing Sheets

FURNITURE SYSTEM HAVING A MODULAR LIGHTING INSTALLATION

FIELD OF THE INVENTION

The invention relates to a furniture system, especially a display cabinet system, having a modular lighting installation which is so designed that a plurality of mutually delimited furniture compartments can be produced, it being possible to install a lighting member in each furniture compartment, and rod elements of a predetermined length being provided to carry the electrical current, which rod members are affixed inside the furniture unit. The invention also relates to a modular lighting installation for a furniture system and a furniture unit with a plurality of furniture compartments.

STATE OF THE ART

Display cabinets have to perform various functions. As the first function, they are required to present articles in a sales outlet, an exhibition, etc., the viewer having no access (or at least no direct access) to the article. The object displayed is intended to produce its optimum effect. In principle, in such cases, the design of the display cabinet should include a reference to the value and significance of the object displayed. For example, it will be inappropriate for a beautiful and valuable article to be placed on show in an esthetically second-rate display cabinet. On the other hand, however, the esthetic qualities of the display cabinet should not overshadow those of the object.

Preferably, the display cabinet enables the object to be viewed from all sides. It should therefore comprise a great deal of glass and few other structural elements. Finally, optimum illumination of the object should also be achieved. This means, in practice, that lighting members are to be installed in the display cabinet itself. For the manufacturer of a display cabinet, this poses the problem of designing the electrical installations in such a way that the visibility of the object is not impaired.

U.S. Pat. No. 5,057,978 has disclosed a low-voltage halogen system for glass display cabinets. The display cabinet consists of a plurality of glass panes directly connected to one another or inserted into a frame. A tubular lamp member, into which a plurality of low-voltage halogen bulbs can be inserted, is supported within the display cabinet by two supports. The supports, which simultaneously serve as a feed for the current, are passed through the base of the display cabinet. They can be designed either as stable rods or as flexible cables. As is apparent from FIG. 1 of that document, the supports are arranged close to the edges of the display cabinet. The current feeds are therefore independent leads within the display cabinet and not part of the furniture frame. The dimensions of the lamp member may be standardized or adapted to the display cabinet.

Display cabinets with integrated lighting systems are also commercially available. These are particularly esthetically satisfactory if the current supply for the illumination of the individual display cabinet compartments is integrated into a continuous vertical support. The support at the same time forms part of the framework structure of the display cabinet. It may be designed either as a stable section (for free-standing display cabinets) or as a wire (for suspended display cabinets). It is either electrified as a whole (which, of course, is possible only with low-voltage lighting systems) or contains an insulated busbar.

The disadvantage of most of the known commercially available display cabinets lies in the fact that they are not of modular design. The user therefore does not have the option of successively extending the display cabinet furnishing. Instead, he has to decide on a whole new furniture unit. The previously known modular display cabinet systems, however, are unsatisfactory from the esthetic and design standpoints.

DESCRIPTION OF THE INVENTION

The object of the invention is to provide a furniture system having a modular lighting installation, which is esthetically pleasing and can be adapted at any time (in other words, even at a later time) to the size of the furniture unit.

This object is achieved as defined by the features of claim 1. According to the invention, the rod elements serving to conduct the electrical current have the length determined in accordance with the internal dimensions of a furniture compartment and are, for example, mounted by mountings in such a way that each of them is located completely within a furniture compartment. Furthermore, electrical connection elements are provided which connect together rod elements of neighboring furniture compartments. The lighting member is connected to two rod elements of different polarities at a point that can be freely selected.

The concept according to the invention is thus based on the fact that the distribution of electrical current within a furniture compartment is undertaken by (standardized) rod elements which simultaneously serve as a support for the lighting members, and that rod elements of neighboring furniture compartments are electrically connected to form a continuous system with the aid of preferably standardized connection elements. In contrast to the prior art represented by U.S. Pat. No. 5,057,978, the rod elements are not passed through the base or any wall. This is an essential aspect of the modular nature of the lighting installation according to the invention.

According to an advantageous embodiment, the connection elements are of flexible design. They may, for example, be insulated cables with plug parts at their ends. The plug parts can be connected to corresponding plug connections of the rod elements. The flexibility of the connection elements permits simple retrofitting of the lighting. It is also possible to produce, using the same connection elements, not only straight connections but also 90° connections (if, for example, two rod elements at an angle of 90° to one another are to be connected in a corner within the same furniture compartment). Instead of insulated cables, it is of course also possible to use flexible wires, small link-type tubes or articulated current conducting elements.

Preferably, connection elements designed in branch form are also provided. the branching can in very general terms be 1:n (n=2, 3, 4, etc). In particular, 1:2 and 1:3 branches will be of particular interest. It should be mentioned here that flexibility is of particularly practical benefit in the case of branches. With rigid connection elements, for example, it will be necessary to keep stocks of differently shaped branches for each branching ratio (for example, on the one hand a branch with one 180° arm and one 90° arm and a branch with two 90° arms). The connection elements can even consist of a plurality of parts that can be assembled by the user himself.

The mountings are, for example, so arranged and designed that the rod elements are essentially fixed at the two ends. In this case, the fixing is to be effective not only transversely to the longitudinal axis of the rod element but also toward the said axis. The majority of each rod element thus remains free for the connection of the lighting members at any desired point. Furthermore, the design is selected so that the connection elements can be connected at any time, as required, to the ends of the rod elements.

The mountings may in principle be a fixed component of the furniture unit. Preferably, however, they are interchangeable or can be retrofitted. At corner elements of the furniture unit it is possible, for example, to design mechanical connections which interact for fixing purposes with the mounting elements. Possible examples include plug, clip and screw connections.

The length of the rod elements is selected so that it essentially corresponds to the length of one edge of a furniture compartment less twice a connection region for the connection element. The connection region is selected to be as small as possible (e.g., 1–5 cm). Ideally, it is exactly large enough for a flexible connection element to provide, as preferred, a straight or a 90° connection. If all furniture compartments of the furniture system have the same dimensions, the lighting installation can manage with one or two types of rod element. (In the case of cubic compartments, one length is sufficient, and in the case of cuboid compartments, one requires no more than two different rods of different lengths—for example, one for leads in the vertical direction and one for leads in the horizontal direction between two vertical leads.) It is of course also possible to provide three or more different of different lengths.

According to a particularly preferred embodiment, the furniture unit has corner elements which are equipped with passages for the connection elements. The walls, tops and bases of the furniture compartment (which may consist of transparent or non-transparent material) are thus retained by corner elements within a frame of the furniture unit and are not themselves particularly adapted to the lighting system. Instead, the structural interaction between lighting system and furniture is confined to the (small) corner elements. In order to retrofit furniture unit with a lighting installation according to the invention, therefore, it is not necessary to replace the (expensive) walls, tops and bases. All that is needed is to replace individual (reasonably priced) corner elements.

Insofar as it is not perceived as disruptive, it is of course also possible to equip all walls, tops and bases with passages as standard, so that lighting can be installed in the furniture unit at any time. This is particular useful if the starting point is a furniture system whose design does not permit the use of replaceable corner elements.

In principle, the possibility is not excluded that the corner elements themselves simultaneously form or contain the electrical connection elements. The rod elements could, in such a case, be connected directly to the corner element. Finally, the mountings may also be integral parts of the wall, base and top panels.

From the detailed description that follows and the complete set of patent claims other advantageous embodiments and feature combinations of the invention will be apparent.

BRIEF DESCRIPTION OF THE DRAWINGS

The drawings used to explain the examples embodiment show.

In principle, identical parts in the figures bear identical reference numerals.

EMBODIMENTS OF THE INVENTION

Figure 1:
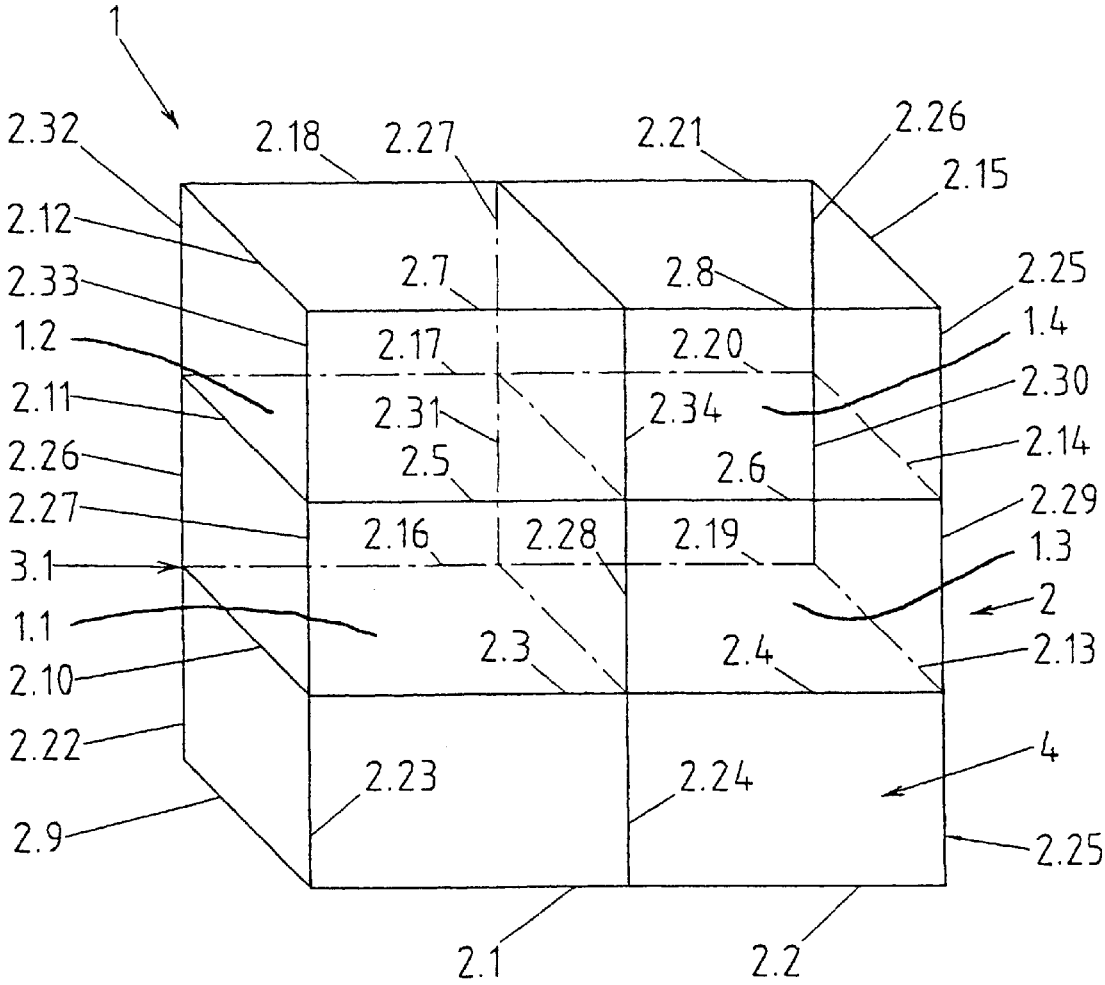
FIG. 1 is a diagrammatic perspective view of a modular display cabinet.

FIG. 1 shows a furniture unit 1 which is designed in the manner of a modular display cabinet. According to a preferred embodiment, the furniture unit 1 is based on a mounting frame 2, which is constructed from tubes 2.1 to 2.37. The tubes are connected by means of junction elements known per se (cf. for example reference numeral 3.1). Wall, base and top elements are inserted in the mounting frame 2 in a manner likewise known per se, so that cuboid spaces are formed. (FIG. 1 shows the general case of cuboid spaces. The special case of cubic spaces, which arises when frame tubes are used that are always of the same length, may offer considerable advantages from a logistical standpoint.)

In the examples of embodiment shown, the wall, base and top elements in a lower region of the furniture unit 1 are non-transparent panels (made, for example, from metal, wood or plastic), so that a closed cabinet 4 is formed. In an upper region of the furniture unit 1 (in the present case above the plane defined by the tubes 2.3, 2.4, 2.10, 2.13, 2.16, 2.19) transparent panels (made, for example, from glass or plastic) are installed in the mounting frame 2. As a result, display cabinet compartments 1.1, 1.2, 1.3, 1.4 are formed, in which objects can be placed on display. The display cabinet compartments 1.1, 1.2, 1.2, 1.4 naturally do not need to be closed. If, for example, the wall elements are omitted from the rear side, the compartments are freely accessible from the rear.

The display cabinet is modular because it is possible to remove or add individual display cabinet compartments at any time without changing the design of the remainder of the display cabinet or furniture unit. In other words, the mounting frame 2 is so designed that is can be extended locally as required.

The display cabinet lighting according to the invention will now be explained in detail.

As the basic concept, each display cabinet compartment 1.1, 1.2, 1.3, 1.4 can be individually illuminated with one or more lighting members. It is also possible to distribute the electrical current in, relatively, any desired manner through the display cabinet compartments 1.1, 1.2, 1.3, 1.4. If the furniture unit is enlarged, the lighting installation can be retrofitted in a modular manner. This means that no existing lighting installations need to be replaced or removed. Instead, it suffices to add new rod elements and connection elements.

In what follows, it is assumed that the lighting is based on a low-voltage halogen system. In this arrangement, two separate electrical current feeds are required for the plus and minus poles. Even if the mounting frame 2 consists of metal and could in principle form a pole, the electrical current, for the purpose of the invention, is fed in via independent leads which are insulated from the mounting frame 2.

Apart from the electrical current feed, all parts of the lighting installation are located inside the furniture unit or the display cabinet compartments 1.1, 1.2, 1.3, 1.4. The electrical current feed takes place, for example, in the region of the junction element 3.1. From here, separate power leads for the two polarities lead into the furniture unit 1 into the various display cabinet compartments 1.1, 1.2, 1.3, 1.4. The power leads are made up of standardized rod elements and equally standardized connection element. The rod elements are passed along the tubes of the mounting frame 2. The connection elements connect the rod elements, either within a particular display cabinet compartment or between two neighboring display cabinet compartments.

For example, one lead may be run along the tubes 2.26, 2.32, 2.18, 2.21, 2.26, 2.30 and the other along the tubes 2.10, 2.27, 2.33, 2.7, 2.8, 2.25, 2.29. In this example, each single display cabinet compartment 1.1, 1.2, 1.3, 1.4 can be individually illuminated by lighting members affixed between the two leads. In the context of the invention, it is also possible to provide branches so that, for example, the electrical current is also carried in the direction of the tube 2.17. Logically, the leads are in each case guided along two mutually opposite sides of a wall, base or top element of the display cabinet compartment in question, so that the lighting member is, as it were, positioned in front of one wall. However, the possibility is not ruled out that a lighting member can be affixed between differently arranged leads, so that it is suspended somewhere in the "free space" of the display cabinet compartment.

Figure 2:
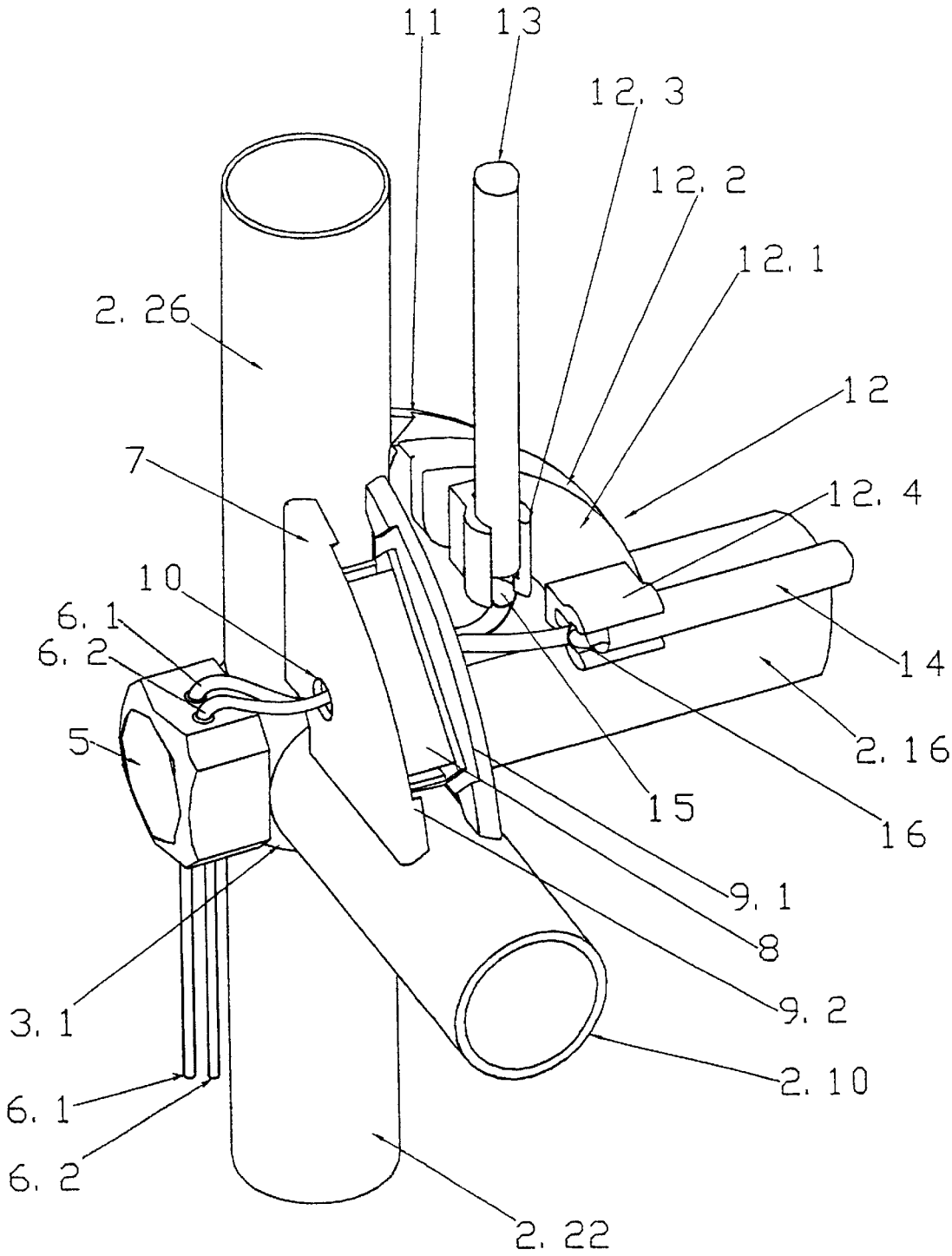
FIG. 2 is a diagrammatic perspective view of the electrical current feed.

FIG. 2 shows a detailed view in perspective. The tubes 2.10, 2.16, 2.22 and 2.26 are releasably connected to one another by the junction element 3.1 (the majority of which is concealed in the drawing). The junction element 3.1 is, for example, a sphere with six threaded holes into which the clamping screws of clamping devices positioned in the tubes can be screwed. On the outside of the furniture unit, for example, a traction relief button 5 is fixed on the junction element 3.1. Two cables 6.1, 6.2 are passed through this button. A corner element 7, which is positioned in the corner between the tube 2.10 and 2.26, possesses a passage aperture 10 for the cables 6.1 and 6.2 reliefed from traction.

The corner element 7 essentially comprises a support member 8 and two lateral guide surfaces 9.1, 9.2. It receives a suitably adapted corner of a wall element (not shown), the guide surfaces 9.1, 9.2 engaging the edges of the wall element on both sides and positioning it in the desired plane. (Each wall element is retained in the mounting frame by four corner elements of the type shown).

FIG. 2 shows another corner element 11, which is located in the corner between the tubes 2.16 and 2.26 and is of identical design to the corner element 7. It serves as a support for a mounting 12, which secures the ends of the current-conducting rods 13, 14. The mounting 12 is, for example, arcuate (in the sense of a quarter-circle) in design, corresponding to the shape of the corner element 11, and has for example a U-shaped cross section. Because of this cross section, the mounting 12 can be suspended on the lateral surface of the corner element 11. In order for the position of the mounting 12 on the corner element 11 to be precisely defined, the two said structural elements (mounting 12/corner element 11) may be provided with suitable recesses or projections in order to provide a latching connection. The recesses/projections are preferably formed at an interior point, in other words not visible from outside, of the side wall of the corner element 11. (In some circumstances it is also possible to dispense with a latching connection of this type, positioning being secured simply by the fact that the two ends of the mounting 12 abut against the tubes 2.16 and 2.26).

In the view shown in FIG. 2, the side wall 12.1 and the arcuate back 12.2 of the securing part of the mounting 12 are visible. Two rod holders 12.3, 12.4 are formed on the side wall 12.1. They are aligned perpendicularly to one another. According to a preferred embodiment, they are designed as pincers with sprung jaws, in a manner such that the rods 13 and 14 can be introduced in the direction transverse to the longitudinal axis into the rod holders 12.3, 12.4.

In FIG. 2, it is apparent that the rods 13 and 14 are retained in such a way that they end in the region between the jaws of the rod holders 12.3, 12.4. In order for the end position to be clearly defined, the rod holders 12.3, 12.4 possess stop elements. In other words, the rod holders 12.3, 12.4 are preferably so designed that the rod (clamped by two rod holders) cannot shift in the axial direction.

The cables 76.1, 6.2 have plugs 15, 16 which can be plugged into the ends of the rods 13, 14. As is apparent from FIG. 2, the rod holders 12.3, 12.4 enclose not only the ends of the rods 13, 14 but also the plugs 15, 16. This, of course, creates the possibility of designing the rod holders 12.3, 12.4 in an alternative form so that they secure the rods 13, 14 not directly but indirectly via the plugs 15, 16. For the purposes of this alternative, therefore, (only) the plug is fixed by the jaws of the rod holder, but the plug in turn holds the rod by means of the plug connection.

The rod holders 12.3, 12.4 are positioned close together within a confined space. The transparent region of the display cabinet is not to be restricted by the corner elements or, therefore, by the mounting 12. The connecting region, which is defined by the distance between the end of the rod 13 and the baseplate (not shown, inserted between the tubes 2.10 and 2.16), is exactly sufficiently large, for example, for the cables 6.1, 6.2 to be able to be connected through the passage aperture 10 of the corner element. (Depending on the flexibility of the cables, a small multiple of the cable diameter is sufficient.) In practice, the connection region is two or three times as large as a rod holder 12.3, 12.4 (or its length in the axial direction).

Figure 3:
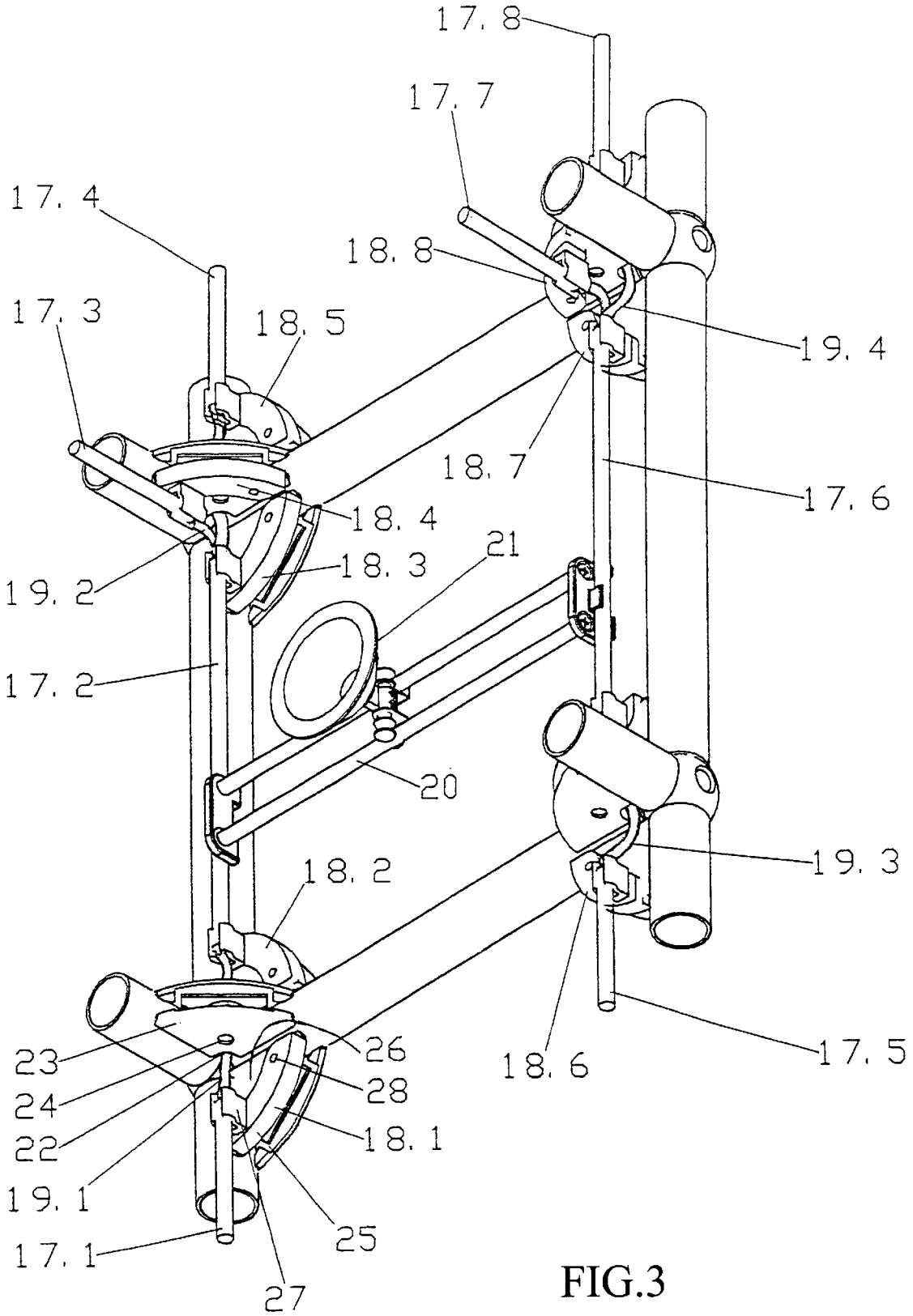
FIG. 3 a diagrammatic perspective view of a lighting installation.

FIG. 3 shows the possible distribution of electrical current within a display cabinet. Along one edge are run rods 17.1, 17.2, 17.4 for one polarity and along the other edge rods 17.5, 17.6, 17.8 for the other polarity of the direct current. The electrically conducting rods 17.1 to 17.8 are held by insulating mountings 18.1 to 18.8. 1:1-couplings 19.1 and 19.3 are provided between the rods 17.1 and 17.2 and between the rods 17.5 and 17.6 respectively. These are short lengths of cable with plugs at both ends. The couplings 19.2 and 19.4 are designed as 1:2-connections. This means that from one plug, which is plugged into the rod 17.2 or 17.6, two cables extend, providing in one case the transition to the rod 17.3 or 17.7 and in the other the transition to the rod 17.4 or 17.8.

The corner element 23, which is for example triangular or slice-shaped, has a small (for example arcuate) recess at the corner facing the junction element, through which recess the coupling 19.1 can be passed. Furthermore, a clamping mechanism is provided in the interior of the corner element 23 and can be actuated by means of a set-screw 24. The clamping mechanism serves to clamp or fix the appropriate wall, base or top panel in the mounting frame (between four corner elements in each case).

If the said panels are secured in another manner, a through hole (in the corner element or in the panel) may be provided, analogously to the through aperture 10 (FIG. 2), for the cable parts instead of the recess at the edge.

As is apparent from FIG. 3, the mountings 18.1 to 18.8 are themselves assembled from a plurality of elements. First, a securing part 25 is provided in each case, which can be suspended on a corner element 26, and secondly pincer-type clamping elements 27 are provided which can be fixed as necessary to the securing part 25 (for example by a plug connection) (cf. the visible plug connection 28). It is thus possible to affix only as many clamping elements as are necessary to each securing part.

To illuminate the object in the display cabinet (or the internal space of the display cabinet) a lighting element comprising a support 20 and a lighting member 21 may be positioned at any desired point. The support 20 is suspended in an electrically conducting manner on the rod 17.2 by one connection and on the rod 17.6 by the other. (The rods 17.2 and 17.6 simultaneously serve, as is apparent, as stable supports and as the electrical current feed to the lighting element.) Because the rods 17.1 to 17.8 are conductive over their entire surface, the lighting element can be positioned at any desired point (free positioning of the lamp). It is also possible to place a number of lighting elements side by side. It will be advantageous here if the lighting member 21 is pivotably mounted on the support 20.

The examples of embodiment described may be modified in many ways. Thus, for example, the mountings may be components of a corner element. The rods are then secured directly on the corner elements. In this case the rods can either be simple metal tubes with no special design at the ends or rod elements with integrated securing devices.

The plug contact between connection element and rod element is particularly preferred but by no means mandatory. Also possible are a clamp engaging around the rod element from outside, a screw connection or another design of contact.

The rod holders can be designed, for the purposes of another embodiment, as sleeves (or small open tubes), in which case they are releasably affixed to the securing part. For example, a plug connection may be provided. During assembly, the sleeve-type rod holders are initially pushed over the two ends of a rod and only then over the plug connection (whose plug axis is, for example, perpendicular to the axis of the rod) on the securing part. This embodiment is distinguished by good axial and radial fixing of the rods.

The furniture design explained with reference to FIG. 1 is by no means a mandatory precondition for the implementation of the modular lighting installation. Rather, the invention is applicable wherever a furniture unit with identical compartments is to be individually illuminated. In particular, book cases, shelf units and the like may also be considered. The particular design or the use of corner elements in the first place is therefore not an essential factor. The wall, base or top panel may also be designed for directly securing the rod elements. For example, holes may be drilled in a sheet of glass into which a mounting for the rod elements can be plugged. Depending on the embodiment of the furniture unit, the possibility also exists of securing the rod elements by means of mountings on the tubes of the frame structure.

Low-voltage halogen systems have the advantage that the voltages arising are non-hazardous to human beings. If steps are taken to ensure that the user cannot come into contact with conductive elements, lighting systems with higher voltages (110 V, 220 V) may also be used. For example, the passage of the electrical current in this case would have to be protected within the rods and the contact with the lighting member would have to be suitably designed to conform to safety regulations.

In summary, it may be said that the invention has resulted in the provision of a lighting device for furniture units and the like which can be adapted flexibly to requirements. In particular, an esthetically satisfactory solution is provided to the problem of lighting modular display cabinets. Although the rod elements are separate from the frame structure, they match the latter visually.

What is claimed is:

1. A furniture system comprising:

a modular lighting installation having is effective so that a plurality of mutually delimited modular compartments, a lighting member in each modular compartment, and rod elements of a predetermined length being provided to carry electrical current, the rod elements are affixed inside each modular compartment, wherein mountings are provided whereby some of the rod elements be completely mounted within a modular compartment and connection elements are provided whereby rod elements electrically connectable to one another.

2. The furniture system according to claim 1, wherein the connection elements are in part flexible conductors.

3. The furniture system according to claim 1, wherein the connection elements are 1:n connections.

4. The furniture system according to claim 1 a mounting is effective so that some of the rod elements are essentially fixed at both ends.

5. The furniture system according to claim 1 wherein some of the rod elements essentially have a length that corresponds to a longitudinal dimension of a modular compartment.

6. The furniture system according to claim 1 wherein a mounting is affixed to a corner element of the modular compartment.

7. The furniture system according to claim 6, wherein another corner element has a recess for one of the connection elements.

8. A modular lighting installation comprising:

a module including rod elements of a predetermined length for conducting electrical current and connection elements, electrically interconnecting the rod elements to one another, and, mountings for connecting some of the rod elements as required to the ends of the rod elements.

9. The lighting installation according to claim 8, wherein the connection elements are in part flexible conductors.

10. A furniture unit, comprising: a plurality of modular compartments and lighting members arranged in the various modular compartments.

at least two rod elements of predetermined length being provided in each of the modular compartments for carrying of electrical current and being affixed completely within each modular compartment and the rod elements of the modular compartments are electrically connected to one another by connection elements.

11. A furniture unit according to claim 10, wherein a wall, a base and/or top panels in a furniture frame are held by corner elements and the connection elements are each passed through a recess or a passage aperture of the corner elements.

12. A furniture unit according to claim 11, wherein the rod elements are fixed by mountings which are supported on the corner element.

* * * * *